US006612086B2

(12) United States Patent
Pitt

(10) Patent No.: US 6,612,086 B2
(45) Date of Patent: Sep. 2, 2003

(54) GRILLE SYSTEMS

(76) Inventor: Alan David Pitt, Tree Tops, 19 Forest Close, Bewdley, Worcestershire DY12 2UF (GB)

( * ) Notice: Subject to any disclaimer, the term of this patent is extended or adjusted under 35 U.S.C. 154(b) by 22 days.

(21) Appl. No.: 09/939,395

(22) Filed: Aug. 24, 2001

(65) Prior Publication Data

US 2002/0046533 A1 Apr. 25, 2002

(30) Foreign Application Priority Data

Aug. 26, 2000 (GB) ..... 0021034

(51) Int. Cl.[7] ..... E04C 2/38

(52) U.S. Cl. ..... 52/665; 52/660; 52/507; 52/655.1; 403/174

(58) Field of Search ..... 52/655.1, 655.2, 52/656.8, 656.9, 660, 665, 663; 49/50; D25/61; 403/171, 172, 173, 174, 192

(56) References Cited

U.S. PATENT DOCUMENTS 4,714,370 A * 12/1987 Chen ..... 403/217
4,723,388 A * 2/1988 Zieg ..... 52/665
4,881,354 A 11/1989 Pitt ..... 52/665
4,905,443 A * 3/1990 Sutcliffe et al. ..... 52/648
D357,544 S * 4/1995 Spransy ..... D25/58
D380,054 S * 6/1997 Littlejohn ..... D25/61

FOREIGN PATENT DOCUMENTS

GB 2 206 916 5/1991

* cited by examiner

*Primary Examiner*—Carl D. Friedman
*Assistant Examiner*—Jennifer I. Thissell
(74) *Attorney, Agent, or Firm*—Peter J. Manus; Edwards & Angell, LLP

(57) ABSTRACT

A grille system comprising at least two rod arrangements 1*a* and at least one clamping member 12. The clamping member 12 retains the rod arrangements b 1*a* in a predetermined spacial configuration. Each rod arrangement 1*a* comprises a straight rod 2 having a first end portion 2*a* provided with an expanded portion 3 received by the clamping member 12. The clamping member 12 comprises two separate, corresponding portions 5 secured together by a bolt 10 and nut 11. The grille system is used as a security grille or in the manufacture of garden furniture or plant supports.

15 Claims, 6 Drawing Sheets

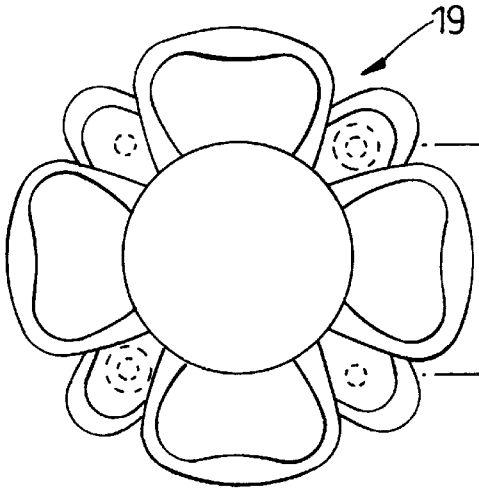
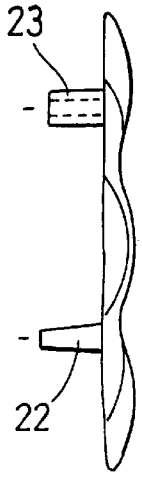
*Fig. 6a* *Fig. 6b*
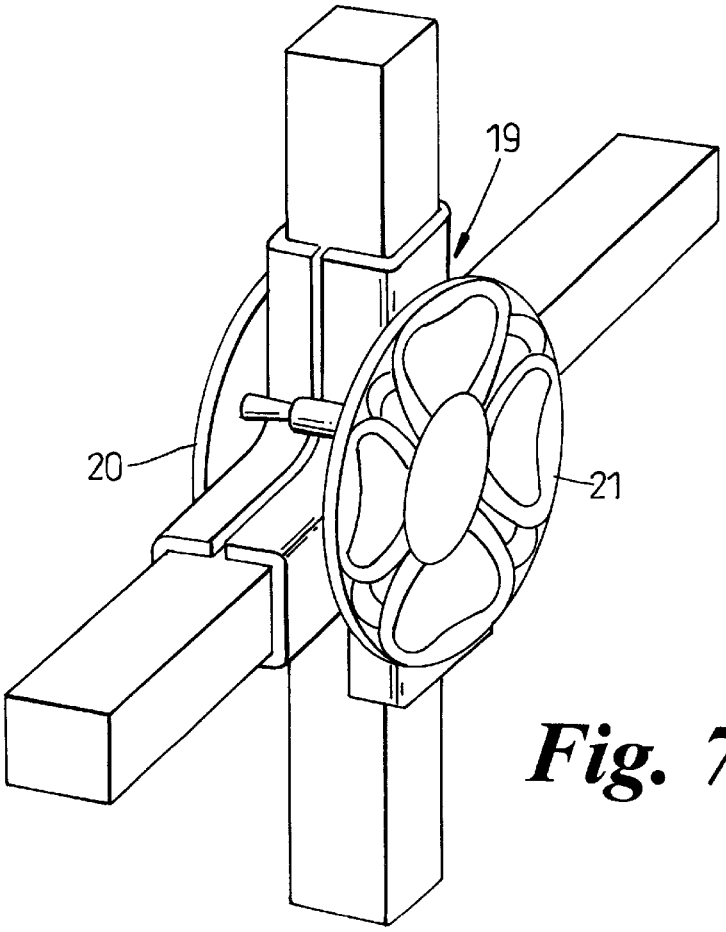
*Fig. 7*

GRILLE SYSTEMS

BACKGROUND OF THE INVENTION

The present invention relates to grille systems having improved strength and rigidity. The grille systems of the present invention are particularly useful as security grilles and load bearing grilles.

Grille systems generally comprise a lattice, grating or screen made from metal parts welded to one another. Grilles can be used over windows and doors of buildings to secure the building against intruders. Such security grilles are usually mounted on the brickwork, masonry or concrete of the building and although specialists can be used to fit the security grilles the majority of users prefer to be able to fit the grille themselves to save on costs.

Grille systems can also be used in a variety of other applications including the manufacture of garden furniture and decorative supports for plants together with household furniture such as shelving systems. Garden furniture, household furniture and plant supports are often large items and it is therefore advantageous to be able to buy these items in kit form for self-assembly.

British patent number 2 206 916 in the name of Alan David Pitt relates to a security grille for self-assembly. The grille is formed from a number of rods received by clamping members to form a grille of the desired size, shape and design.

The grille system of British patent number 2 206 916 has associated with it the problem of the application of a load, particularly at right angles to the rods, resulting in the rods withdrawing out of the clamping member. This is very undesirable in security grilles as it means the grille can be deformed and even dismantled by the application of appropriate force.

When used in the manufacture of garden furniture or supports for plants the problems associated with the prior art system can lead to deformation or destruction of the article if a great load is applied thereto.

The present invention aims to overcome the problem associated with the prior known grille system.

SUMMARY OF THE INVENTION

Accordingly the present invention provides a grille system comprising at least two rod arrangements and at least one clamping member to retain the rod arrangements in a predetermined spatial configuration, each rod arrangement having at least a first end portion and a second end portion wherein at least the first end portion of each rod arrangement is received by a clamping member and at least the first end portion of each rod arrangement is provided with an expanded portion to prevent the rod arrangement from being withdrawn from the clamping member.

The use of an expanded portion on the end portion of the rod arrangement to be received by the clamping member creates a stop which is held in the clamping member even when force is applied to the resulting grille system, for example at right angles thereto. The result is a grille system having improved strength and rigidity.

Preferably the grille system comprises three of four rod arrangements retained by each clamping member.

Each rod arrangement may comprise a straight rod wherein the second end portion is preferably also provided with an expanded portion.

Two pairs of straight rods may be provided with one pair arranged on a first straight line which is normal to a second straight line on which the other pair of rods is arranged, the first ends of each of the four rods are provided with expanded portions and received by a clamping member. A grille may be built up by providing the second ends of the rods with expanded portions for receipt by further clamping members.

The rod arrangement may comprise a cross or other lattice shape having at least a first end portion and a second end portion. Expanded portions may be provided on at least the first and second end portions.

The expanded portions are preferably integral with the rod arrangements. The expanded end portions are most preferably flared portions.

The rod arrangements may be of square or circular cross section and may be hollow or solid. The rods may be made from, for example, cold drawn steel, Electric Resistance Welded (ERW) steel tube or aluminium. The rod arrangements may be formed by upset forging or in the case of ERW steel tube swaging or pressing or in the case of aluminium die or sand casting.

The clamping member preferably comprises two separate but corresponding portions that can be joined together, for example by a bolt, to clamp the expanded ends of the rod arrangements therebetween. Each of the two separate portions comprises a central portion and a plurality of channel shaped limbs extending radially from the central portion to receive the ends of the rod arrangements. The channel shaped limbs of the clamping member are preferably canted away from the plane of the central portion of the clamping member in the direction in which the side walls of the channel shaped limbs extend. The channel shaped limbs are preferably canted at an angle of from 4° to 5° from the plane in which the central portion lies.

By way of their manufacturing tolerances the rod arrangements may vary in size. If the clamping device was rigid not all of the rods would be put under pressure. The use of a clamping device having a degree of cant and "flexibility" results in all rod arrangements being gripped and the tolerance differential being overcome.

The clamping member is preferably cruciform in shape. The clamping member may be made from mild steel or spring steel. After heat treatment spring steel would provide more resilience to distortion and therefore a higher degree of security when used for security purposes.

The grille system of the present invention is particularly useful in the manufacture of a security grille whereby free ends of at least some of the rod arrangements are secured to a building so that the grille extends across a door or a window.

The grille system of the present invention can also be used in the manufacture of garden furniture and plant supports whereby decorative and load bearing structures are formed from the grille system.

The present invention will now be described in further detail with reference to the drawings in which:

BRIEF DESCRIPTION OF THE DRAWINGS

FIG. 6*a* shows a plan view of a further decorative cover for the clamping member;

FIG. 6*b* shows a side view of the further decorative cover of FIG. 6*a;*

FIG. 7 shows the decorative cover of FIGS. 6*a* and 6*b* in use;

DETAILED DESCRIPTION OF THE INVENTION

Figure 1:
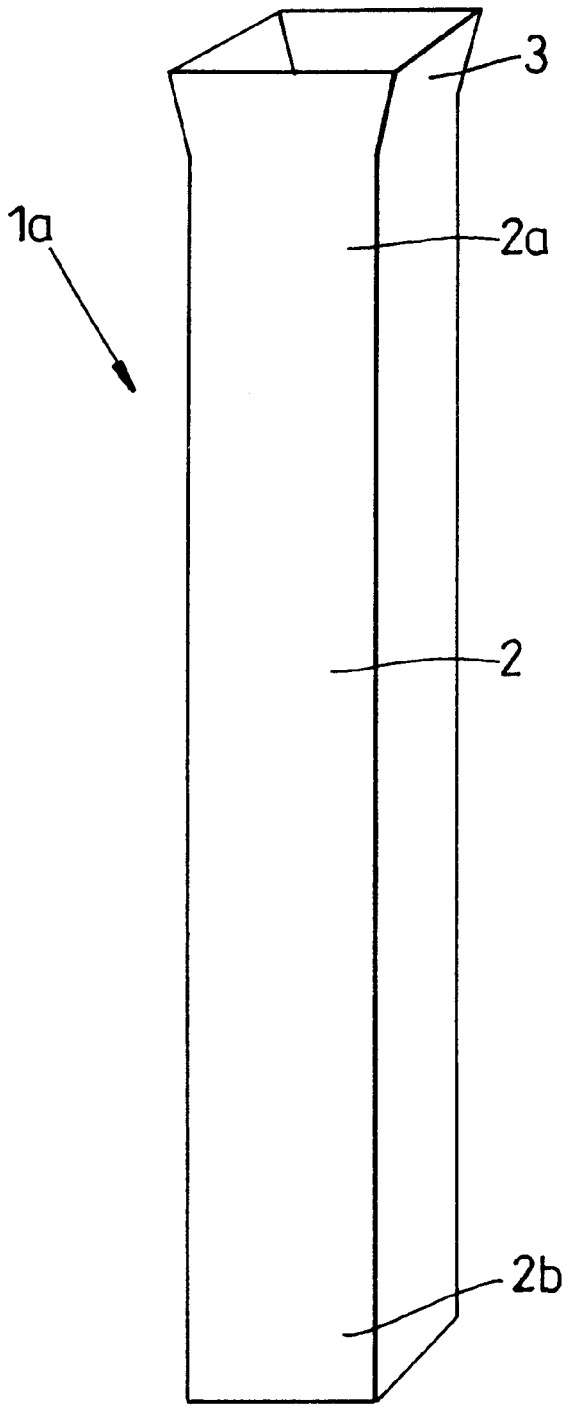
FIG. 1 shows a perspective view of a rod arrangement according to a first embodiment of the present invention.

A rod arrangement 1*a* comprising a straight, square sectioned rod 2 made of cold-drawn steel is shown in FIG. 1. The rod 2 has a first end 2*a* and a second end 2*b*. The first end 2*a* is provided with an integral flared portion 3 formed by upset forging.

Figure 2:
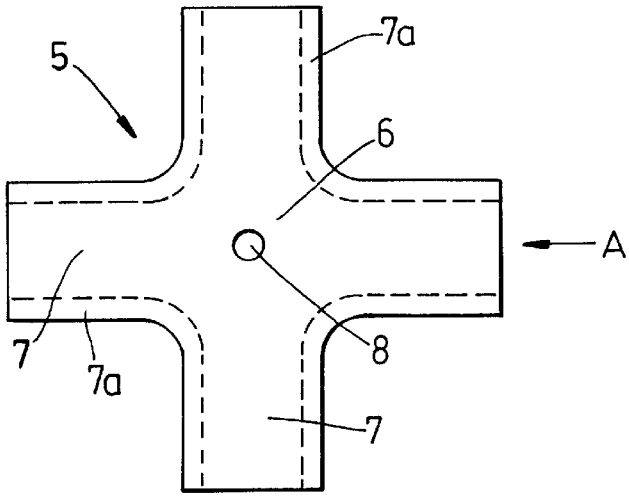
FIG. 2 shows a plan view of one portion of the clamping member.
Figure 3:
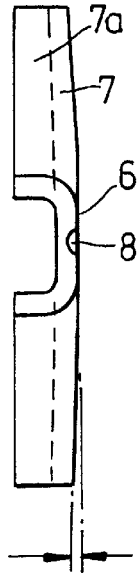
FIG. 3 shows a side view of the portion of the clamping member shown in FIG. 2, looking in the direction indicated by arrow A in FIG. 2.

One portion 5 of a clamping member 12 of the present invention is shown in FIGS. 2 and 3. The portion 5 has a central portion 6 with four channel shaped limbs 7 extending therefrom. The central portion 6 is provided with a central aperture 8.

FIG. 3 shows the way in which the channel shaped limbs 7 are canted away from the plane of the central portion 6 in the direction in which the side walls 7*a* extend at an angle of 4°–5°.

The portion 5 of the clamping member 12 is formed as a pressing and the aperture 8 is added in the same step. The portion 5 is formed from mild steel.

Figure 4:
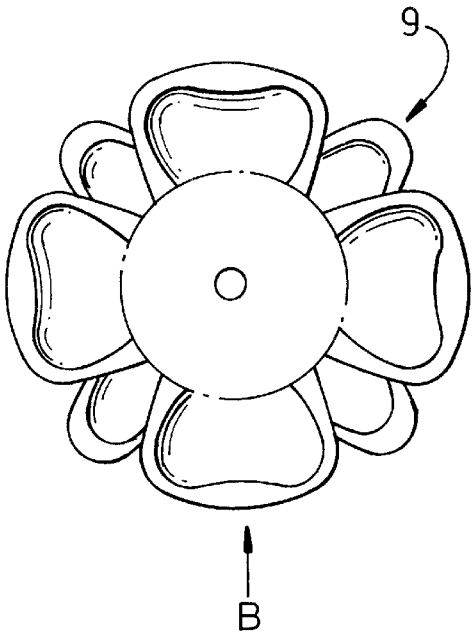
FIG. 4 shows a plan view of a decorative cover for the clamping member.
Figure 5:
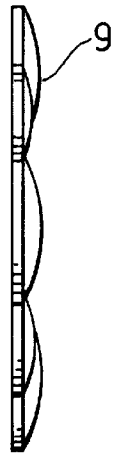
FIG. 5 shows a side view of the decorative cover of FIG. 4.

A decorative cover 9 which can optionally be secured to the portion 5 of the clamping member by means of a hardened steel bush insert (not shown) to give a unitary structure is shown in FIGS. 4 and 5.

An alternative decorative cover 19 is shown in FIGS. 6*a*, 6*b* and 7. The cover 19 is formed from two parts 20, 21 which are joined together around the clamping member 12 by corresponding male 22 and female 23 connecting portions. The portions 20 and 21 are plastic mouldings.

Figure 8:
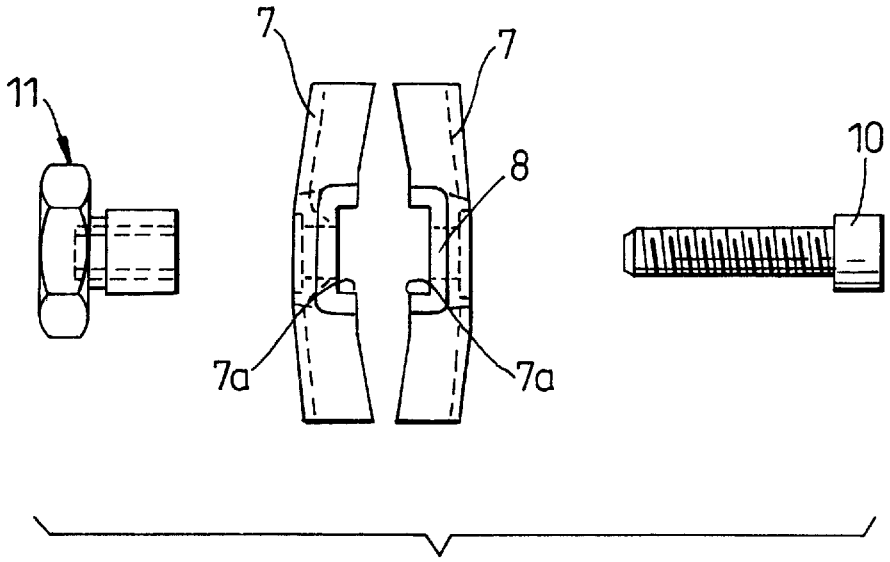
FIG. 8 shows a cross-sectional view of the clamping member of the present invention.

Two separate portions 5 secured together to form a clamping member 12 of the present invention are shown in FIG. 8. The two portions 5 are held together by a round headed bolt 10 which has no slot or recess to aid turning. The bolt 10 is made from high carbon alloy steel and is heat-treated to make drilling out difficult. The bolt 10 engages a hexagonal headed nut 11. The head of the nut shears off at a predetermined torque level, which leaves a threaded annulus and makes removal impossible. The centre of the portion 5 of the clamping member 12 is depressed to reduce access to the round-headed nut 11.

The combination of the above factors makes the nut 11 and bolt 10 difficult to remove from the clamping member 12.

Figure 9:
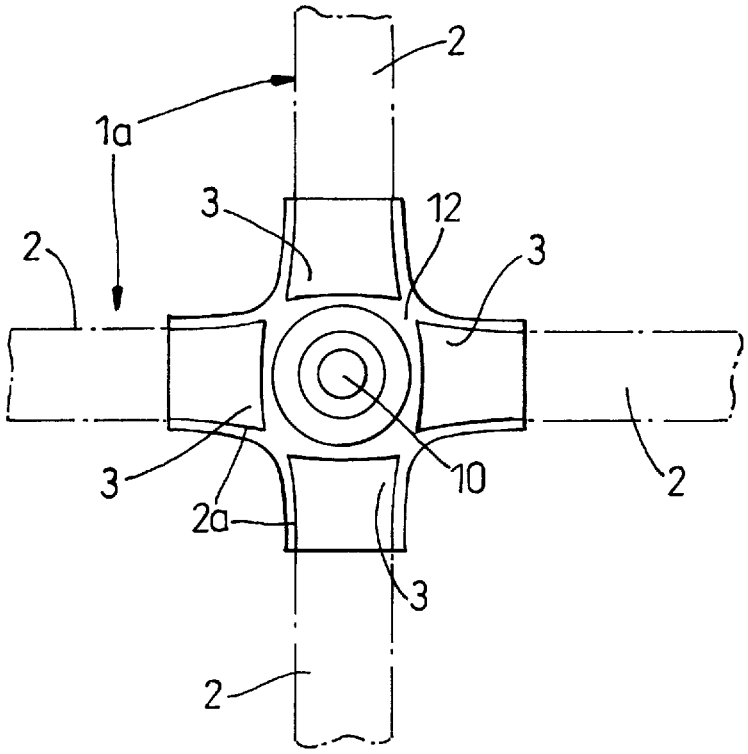
FIG. 9 shows the way in which the rod arrangements of the present invention can be secured together using the clamping member.

FIG. 9 shows the way in which four rod arrangements 1*a* comprising straight rods 2 are secured together by a clamping member 12. The straight rods 2 are held at right angles to each other within the two portions 5 of the clamping member 12 which are secured by bolt 10 and nut 11. The ends 2*a* of the rods are provided with flared portions 3 which are received within the clamping member 12 and result in the rods 2 being securely held in the clamping member 12 even on the application of considerable force.

Figure 10:
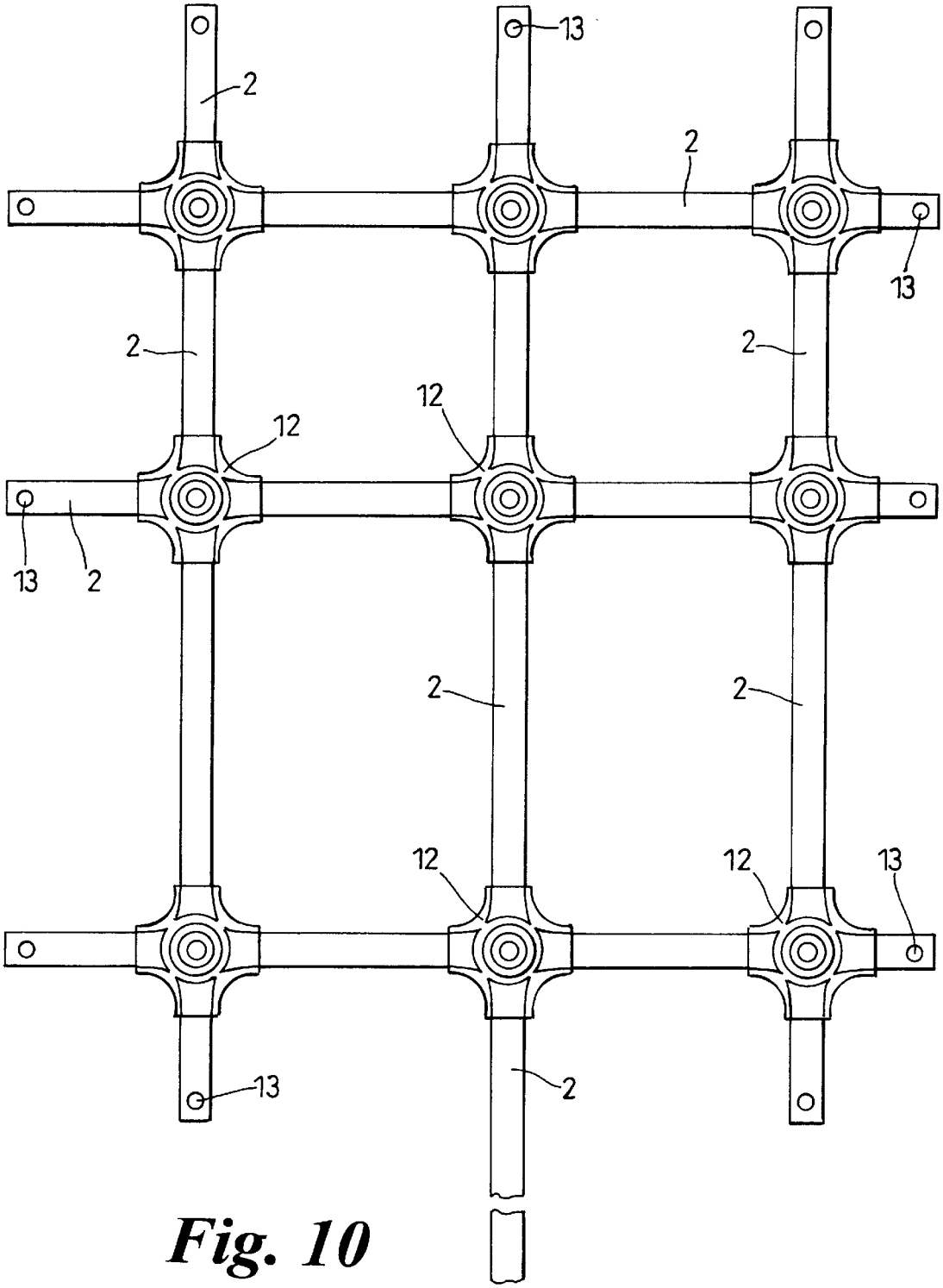
FIG. 10 shows one type of grille which can be achieved using the rod arrangements and clamping members of the present invention.

A security grille built up from the system of FIG. 9 having holes 13 for securing the grille to a portion of a building to cover a door or a window by the use of appropriate fastening means such as screws is shown in FIG. 10.

Figure 11:
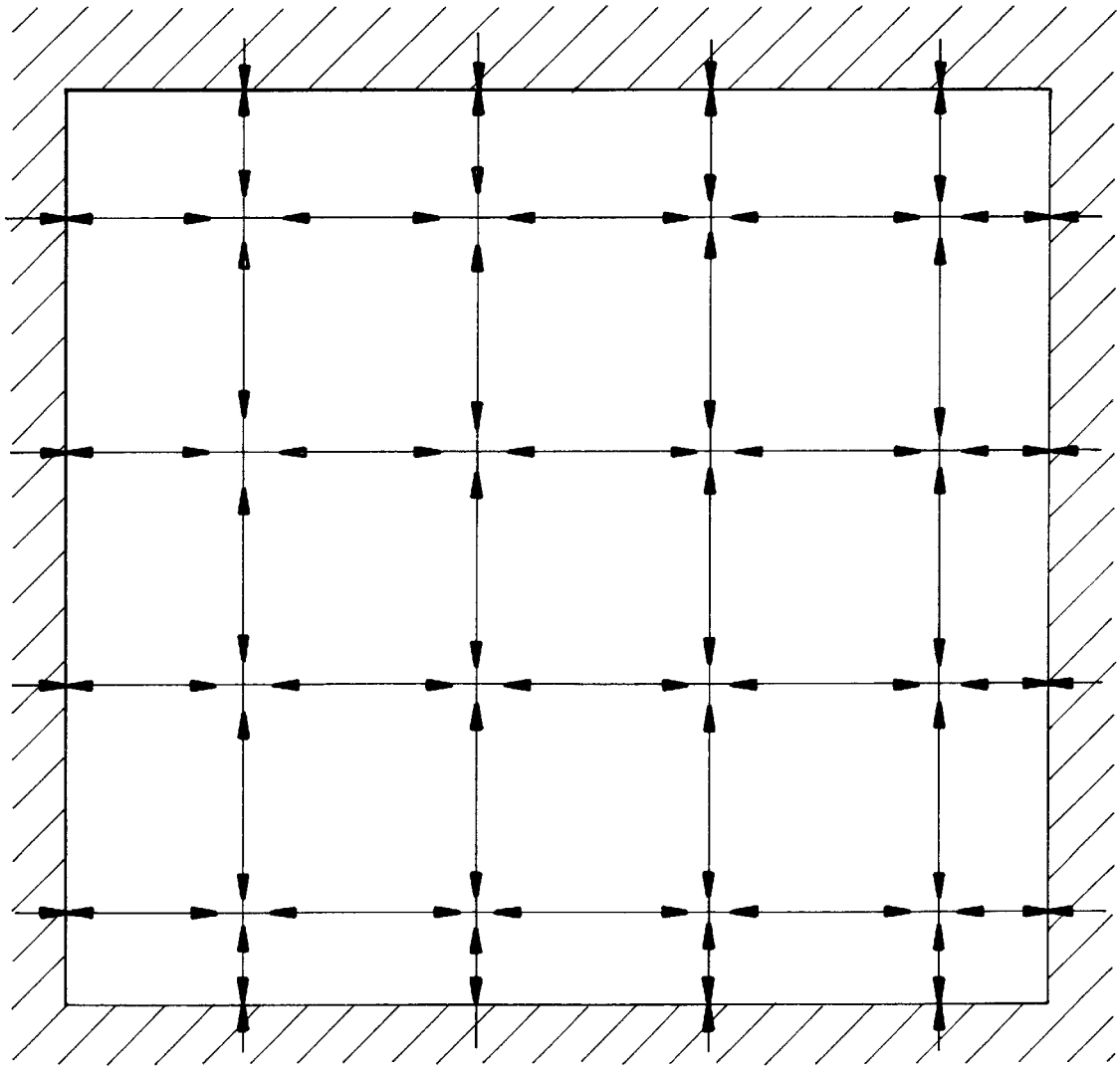
FIG. 11 shows a force diagram for the arrangement in FIG. 10.

FIG. 11 shows the direction of the forces created over the grille of the present invention when it is secured to portions of a building on all four sides and a load is applied at right angles to the plane of the grille. Application of a load at right angles forces the rods to go into tension and pull away from the clamping members. When the forces are equal and opposite throughout the structure then there is no movement in the structure. The rod arrangements are then positively held at both their ends resulting in a strong and rigid structure with the clamping members having increased hold on the rod arrangements owing to the flared portions of the rod arrangements engaging the clamping members.

The invention has been described specifically with reference to security grilles but the skilled man will understand that the grilles of the present invention can be used in any situation where strength and rigidity are required.

What is claimed is:

1. A grille system comprising at least two rod arrangements and at least one clamping member to retain the rod arrangements in a predetermined spatial configuration, each said rod arrangement having at least a first end portion and a second end portion wherein at least said first end portion of each said rod arrangement is received by a said clamping member and at least said first end portion of each said rod arrangement is provided with a radially expanded portion.

2. The grille system of claim 1 wherein three or four said rod arrangements are retained by each said clamping member.

3. The grille system of claim 1 wherein each said rod arrangement comprises a straight rod having a first end portion and a second end portion.

4. The grille system of claim 3 wherein two pairs of said straight rods are provided with one said pair arranged on a first straight line which is normal to a second straight line on which the other said pair of rods is arranged, said first end portions of each of said four rods being provided with expanded portions and received by a said clamping member.

5. The grille system of claim 4 wherein said second end portion of each said straight rod is provided with a radially expanded end portion for receipt by further clamping members.

6. The grille system of claim 1 wherein each said rod arrangement comprises a cross or other lattice shape having at least a first end portion and a second end portion.

7. The grille system of claim 6 wherein expanded portions are provided on at least said first end portion and said second end portion.

8. The grille system of claim 1 wherein said expanded portion is integral with said rod arrangement.

9. The grille system of claim 1 wherein the radially expanded portion is a flared portion.

10. The grille system of claim 1 wherein said clamping member comprises two separate, corresponding portions.

11. The grille system of claim 10 wherein each said separate portion comprises a central portion and a plurality of channel shaped limbs extending radially from said central portion.

12. The grille system of claim 11 wherein said channel shaped limbs of the clamping member are canted away from the plane of said central portion of said clamping member in the direction in which side walls of the channel shaped limbs extend.

13. A security grille comprising the grille system of claim 1 wherein at least some of said rod arrangements are secured to a building so that said grille extends across a door or a window.

14. A load bearing structure formed from the grille system of claim 1.

15. A decorative structure formed from the grille system of claim 1.

* * * * *